US006076635A

United States Patent [19]

Dame

[11] Patent Number: 6,076,635

[45] Date of Patent: Jun. 20, 2000

[54] STEP STOOL WITH A FLEXIBLE HIGH HANDLE

[76] Inventor: Don Dame, 6740 Ashwood Rd. #203, Woodbury, Minn. 55125

[21] Appl. No.: 09/217,804

[22] Filed: Dec. 21, 1998

[51] Int. Cl.[7] ..... E06C 7/18

[52] U.S. Cl. ..... 182/106; 135/65; 135/76; 182/113

[58] Field of Search ..... 182/106, 113; 135/65, 76; D25/65

[56] References Cited

U.S. PATENT DOCUMENTS

| | | | |
|---|---|---|---|
| D. 172,126 | 5/1954 | Conhaim | D15/8 |
| D. 174,616 | 5/1955 | Dixon | D15/8 |
| D. 269,828 | 7/1983 | Greene | D6/33 |
| D. 271,256 | 11/1983 | McClelland | D6/32 |
| D. 346,704 | 5/1994 | Grosfillex | D6/349 |
| D. 367,967 | 3/1996 | Calmeise | D6/336 |
| D. 372,743 | 8/1996 | Ringo | D21/59 |
| 3,743,051 | 7/1973 | Cramer | 182/106 X |
| 3,826,336 | 7/1974 | Cramer | 182/15 |
| 3,841,437 | 10/1974 | Caughey | 182/16 |
| 3,884,327 | 5/1975 | Zigman | 182/106 X |
| 3,967,695 | 7/1976 | Waddell | 182/86 |
| 4,034,829 | 7/1977 | Hoffman | 182/106 |
| 4,054,299 | 10/1977 | Urbaitis | 280/163 |
| 4,113,161 | 9/1978 | Manuszak | 182/106 X |
| 4,333,547 | 6/1982 | Johansson | 182/90 |
| 4,378,862 | 4/1983 | Carmel | 182/106 |
| 4,524,483 | 6/1985 | Lynham | 16/114 |
| 4,574,990 | 3/1986 | Remis | 224/255 |
| 4,664,227 | 5/1987 | Hansen | 182/106 X |
| 4,842,174 | 6/1989 | Sheppard | 224/273 |
| 4,950,033 | 8/1990 | Anderson | 182/33 X |
| 5,007,654 | 4/1991 | Sauber | 280/166 |
| 5,064,023 | 11/1991 | Loeber | 182/90 |
| 5,131,494 | 7/1992 | Heifetz | 182/106 |
| 5,323,887 | 6/1994 | Scicluna | 190/18 |
| 5,402,587 | 4/1995 | Buschbacher | 297/5 X |
| 5,518,084 | 5/1996 | Short et al. | 182/223 |
| 5,697,626 | 12/1997 | McDaniel | 280/166 |
| 5,713,614 | 2/1998 | Anderson | 292/336 |
| 5,842,709 | 12/1998 | Maccabee | 182/127 X |

OTHER PUBLICATIONS 1998 (No Month Available) Housmann Footstool with Safety Handrail. # A370–363 Smith & Nephew 1998 Catalog Germantown Wisc. p. 183.

*Primary Examiner*—Daniel P. Stodola
*Assistant Examiner*—Hugh B. Thompson

[57] ABSTRACT

A portable step stool assembly including a step stool having a bottom surface adapted to be supported on a generally horizontal support surface and having a top surface adapted to be stepped on by a person. The assembly further includes an elongate resiliently flexible handle which is sufficiently stiff to remain straight when supported from one of its end portions. One end portion of the handle is attached to the step stool with the handle normally projecting upwardly past its top surface to a position where its opposite end portion can be grasped by a user of the step stool assembly. The handle is resiliently flexible in any direction normal to its longitudinal axis which restricts injury should a person fall against the handle and facilitates storage of the step stool assembly.

18 Claims, 1 Drawing Sheet

STEP STOOL WITH A FLEXIBLE HIGH HANDLE

BACKGROUND

The present invention relates to the need for a lightweight step stool with a flexible high handle.

The commercial marketplace now sells some step stools, which do not have a handle, and the lack of an adequate handle makes it difficult for some infirm, or handicapped, or weak people to move and to use the step stool. The commercial marketplace also sells heavy metal step stools, which have a heavy metal "U" shaped rigid high handle. These step stool assemblies are so heavy that infirm, handicapped, weak people who need a step stool, cannot use these heavy step stools, because they cannot lift or move them. The reason that rigid high handled step stools are so heavy is because people may possibly apply a substantial force to the rigid handle. Therefore, the step stool and the rigid handle must be made heavy enough and strong enough to withstand the potential forces which users may apply to the rigid handle. In addition, extra weight results when extra surface area is provided on the top of the rigid handle, in order to prevent an injury to a person's body, in the event that a person were to fall onto the handle. If the handle did not have the extra surface area, then a rigid handle with a small cross sectional area would allow the rigid handle to pierce a person's body like a sword.

There is a need for a safer, more convenient, lightweight step stool with a safer, flexible handle. The handle typically needs to be elevated off the ground by about 25 inches, or whatever other height is appropriate, depending on how the step stool is being used. The person who is using the step stool needs to be able to conveniently reach the handle while they are in the typical position for using the step stool, for example, the user may be either standing in a generally erect position, or the user may be sitting in a vehicle's seat.

NEED FOR THE INVENTION

The need for a better step stool exists in at least four market niches.

For example, there is a market niche, which includes people who are recovering from major surgery, who temporarily have limited mobility, and who at the same time want to drive their high pickup truck. It is often impossible for these limited mobility patients to get into a pickup truck without some kind of assistance. The problem begins several days after major surgery, when the patients are well enough to drive alone, if they could only get into their vehicle. During this same period of time, people with desk jobs could go back to work, if they could only drive themselves to work and back, alone. It is especially difficult for people who happen to drive full size pickup trucks, SUV, or vans. During this time period, the patient is required to have a second person travel with them everywhere they go, in order to pick up the step stool after the driver has used the step stool to enter the vehicle at the start of the trip, and to set down the step stool on the ground, in the correct place, at the end of the trip, to allow the driver to get out of the vehicle. Even patients who are just passengers in the vehicle would probably like the independence of being able pull in, and set down the step stool themselves, rather than watching while someone else is forced to do the job for them. When patients ask medical professionals for advice on how get into high vehicles, without assistance, many medical professionals advise their patients to buy a new vehicle with a lower seat. A light weight step stool with a safe flexible handle, whose handle is high enough to be reached by a person who is seated in a vehicle, would solve all of these problems, at a lower, more reasonable cost, than purchasing a new vehicle with a lower seat. Because this invention is such a simple idea, a phenomena is occurring which occurs after every simple, but important invention is disclosed. After the invention is disclosed, everyone says that the new invention is obvious, and that anyone could have invented that simple idea if they had wanted to. The point is that millions of very smart medical professionals gave their patients very bad advice for generations, because none of these millions of smart medical professionals realized that fastening a short length of flexible rubber hose to light plastic step stool would solve the problem for a much lower cost, than having the patients buy a new car with a lower seat. It seems that many simple inventions are characterized as obvious only after someone invents them. The solution to the problem is never considered to be obvious before the invention is created.

Another market niche would be for short women who sometimes wear constricting dresses or skirts, who typically have a difficult time getting into high pickup trucks. The truck cab mounted steps, which are presently available, are still too high to solve the problem. A step stool with a flexible high handle would solve the problem, since it would allow short people to have safe, unassisted access to high vehicles. As indicated in the previous paragraph, even though millions of pickup trucks are sold every year, and virtually every high pickup truck owner is confronted with the problem that some short people cannot easily and safely get into their pickup trucks, no one else, prior to this invention, realized that a reasonable and low cost solution to the problem, was to fasten a couple of feet of flexible tube to a lightweight plastic step stool. Millions of pickup truck owners have been seeking a simple solution, to the difficult access problem, for 50 years, ever since large running boards disappeared from motor vehicles. No one else realized that the solution to the high vehicle access problem was to fasten a couple of feet of flexible tube to a lightweight plastic step stool.

Another market niche would be for older people, who may have disabilities such as arthritis, who sometimes have trouble getting into even standard passenger cars, or city busses or recreational vehicles or trains.

Another market niche would be for average healthy people, who would probably prefer a step stool with a flexible lightweight high handle for everyday use around the house. At some point in our lives, bending over to pick up a step stool becomes more difficult, sometimes unsafe, and often more effort than we chose to exert. If a safe light step stool with a flexible high handle were available, many people would probably buy a step stool with a flexible high handle, instead of buying a step stool without a handle. The popularity of TV remote controls demonstrates that Americans do not want to exert themselves if there is a reduced exertion alternative available, such as a lightweight step stool with a flexible high handle.

ADVANTAGES OF THE INVENTION

A step stool with a flexible high handle allows a safe lightweight step stool to be produced. There are two reasons why a step stool with a flexible handle would be lighter in weight. The first reason is because a lightweight, small cross sectional area, flexible handle can safely be used, since the handle would safely flex away from the person, without applying enough force to injure the person, if a person were to fall on the small cross sectional area flexible handle. The flexible handle could not act like a sword. The second reason why a step stool with a flexible handle would be lighter in weight is because a flexible handle would not allow a significant force to be transmitted to the step stool structure through the flexible handle, or as an alternate, through a flexible support structure for the handle, therefore, the step stool structure could be made lighter in weight. In other words, no person would ever be able to push on the flexible handle with enough force to cause damage to either themselves, or the lightweight step stool structure.

The step stool with a flexible high handle could be made as a one piece unit, or it could be made as an assembly of several components, as long as the final unit had a step stool portion and a flexible handle portion, and as long as the handle had enough flexibility to not act as a sword, and as long as the handle would flex without applying excessive force to the step stool structure, and as long as the handle was high enough and had enough rigidity so that it would remain in position where a person could reach it conveniently. Anyone who is skilled in the art of manufacturing would be able to select a hose or tube or some other flexible member, with the proper amount of flexibility or rigidity, which is flexible enough to not cause harm, and rigid enough to stay in position where it could be reached.

A METHOD FOR CONSTRUCTING THE INVENTION

As an example, one of the ways in which a step stool with a flexible handle could be made would be to fasten a straight piece of rubber hose, about 2 inches in diameter and about 25 inches long, to one of the legs of a four legged, light weight plastic step stool. These lightweight plastic step stools are manufactured by companies such as Rubbermaid Incorporated™ and they are widely available in stores everywhere. The rubber hose acts as the step stool's flexible handle, and these hoses are available with enough flexibility so that the hose/handle would never act as a sword to pierce the body, if a person were to fall on the flexible handle, and the hose/handle would never be able to apply enough force to the step stool structure to cause structural damage. Flexible hose is available with enough rigidity to remain in a generally erect position, so that users could reach it from either a standing or sitting position. There are many other ways to make a step stool with a flexible high handle. For example, the entire unit could be molded as one plastic part, with a step stool portion and with a flexible high handle portion, as part of the one molded part. As an alternate, the handle could be made foldable or detachable from the step stool, and the legs could be made foldable or detachable, for example, to make the product easier to store. A slip resistant surface could be used on the bottom of the legs. In addition, the geometry of the product could be arranged so that the step stools would be stackable, to facilitate shipping. Anyone who is skilled in manufacturing techniques could select many different ways in which to produce a step stool with a flexible high handle.

SUMMARY

A step stool with a flexible high handle would be both safer, because of the safer flexible handle, and easier to use, because it would be lighter in weight. Some of the step stool's disclosures are as follows:

A step stool in combination with a flexible high handle should have enough flexibility so that the flexible handle cannot produce excessive stress, and/or strain, and/or deformation in the step stool's structure, whereby there would be a significant increase in the safety and convenience for a large number of people such as recovering surgery patients or short people who want to enter high pickup trucks.

A step stool wherein the flexible handle has enough flexibility so that the flexible handle will not injure a person who falls against it.

A step stool wherein the flexible handle is positioned high enough to be reached by a person who is standing in a generally erect position, whereby the flexible high handle will make said step stool easier, and safer for infirm or handicapped people to use.

A step stool wherein the flexible handle is positioned high enough to be reached by a person who is seated in a high pickup truck, and similar high vehicles, whereby the step stool in combination with a flexible high handle will facilitate a person's ingress and egress from a high pickup truck, since the person will be able to lift the step stool into the pickup, after ingress, and store the step stool in the pickup while traveling, and at the end of the trip, from a seated position inside the pickup truck, the person will be able to position the step stool in the proper position on the ground, in preparation for egress from the pickup.

A step stool wherein the step stool and the flexible handle is made from non-metallic materials, such as plastic or rubbery materials, which will be less likely to harm the adjacent surfaces, while the step stool is being stored.

A step stool wherein the improvement is a flexible handle having a helical thread shape which can mesh with a mating helical thread shape which is formed as part of the step stool element whereby the flexible handle may be unscrewed from and separated from the step stool to facilitate shipping and storage.

A step stool in combination with a handle, wherein the improvement comprises an improved composition of matter, which consists of utilizing readily available components, such as commonly available flexible elastomer tubing, either hollow or solid, as said handle means, whereby we achieve a relatively low production cost, and a relatively low weight step stool means with a flexible high handle means.

A step stool means in combination with a handle means wherein the improvement is a new use for a step stool with handle, for ingress to, and egress from, a high pickup truck, or similar high vehicle, whereby said step stool in combination with said handle will facilitate a person's ingress and egress from a high pickup truck, since the person will be able to lift the said step stool into the pickup, after ingress, and store said step stool in the pickup while traveling, and at the end of the trip, from a seated position inside the pickup truck, the person will be able to position said step stool in the proper position on the ground, in preparation for egress from the pickup, which will result in a safer and easier way to access pickup trucks.

DESCRIPTION

Figure 1:
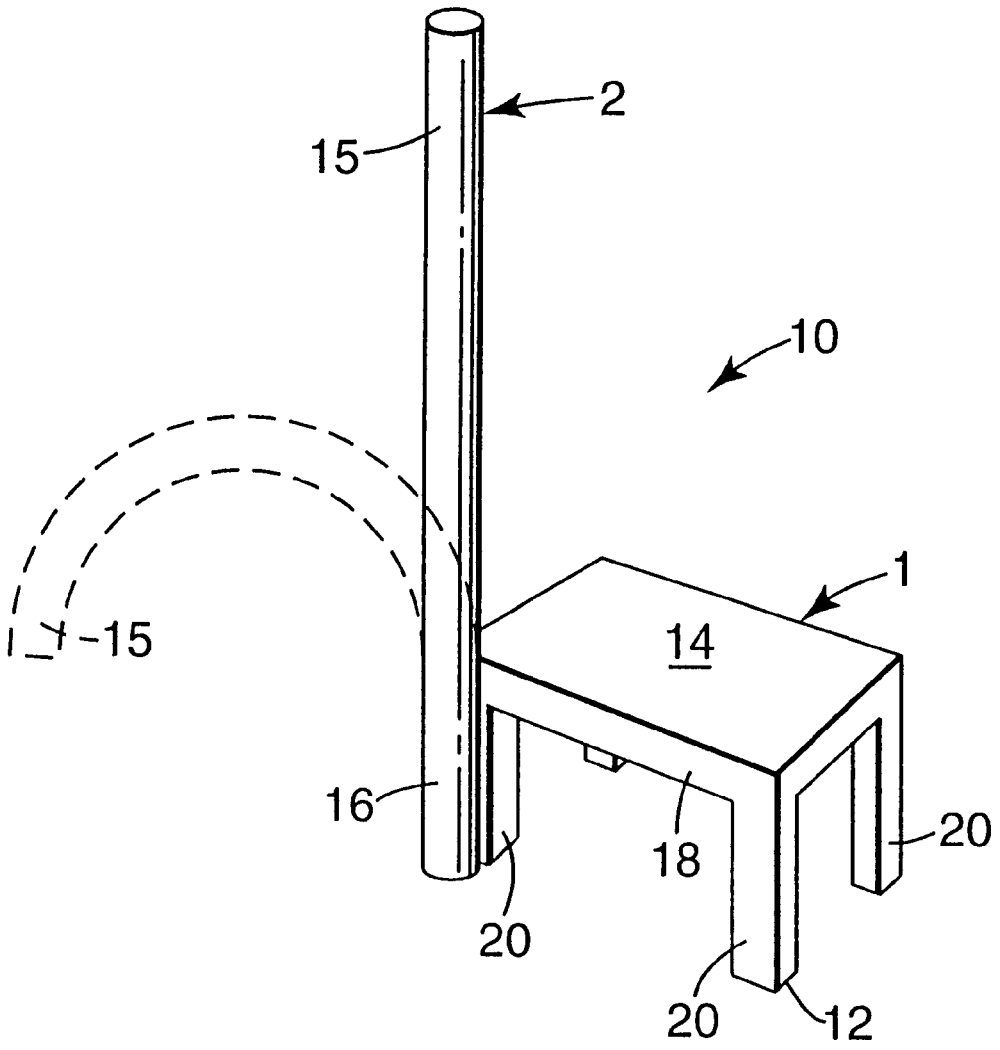
FIG. 1, shows a step stool with a flexible high handle as a single unit in this embodiment. There are other possible embodiments. The unit contains two elements, a step stool element 1, and a handle element 2.

Referring now to the drawing, there is illustrated a portable step stool assembly according to the present invention generally designated by the reference numeral 10. The step stool assembly 10 includes a step stool 1 defining a bottom surface 12 adapted to be supported on a generally horizontal support surface and having a generally planar top surface 14 generally parallel to and spaced a predetermined distance from its bottom surface 12, which top surface 14 is adapted to be stepped on by a person. The step stool assembly 10 further includes an elongate resiliently flexible handle 2 having a longitudinal axis and axially spaced first and second end portions 15 and 16. The handle 2 has its second end portion 16 attached to the step stool 1 and is sufficiently stiff to normally remain generally straight with the axis of the handle 2 projecting past the top surface 14 at generally a right angle with respect to the top surface 14 as is illustrated in solid outline. The handle 2 is flexible in any direction normal to its axis to afford flexing of the handle 2 (as is illustrated in dotted outline) without flexing of the step stool 1 and without damage to the step stool assembly 10, and to restrict injury to a person falling against the first end portion 15 of the handle 2. The flexibility of the handle 2 normal to its longitudinal axis affords positioning of a portion of its longitudinal axis adjacent its first end portion 15 at angles in either of two opposite directions of over 30, 45 or even 90 degrees with respect to a portion of its longitudinal axis adjacent its second end portion 16, thereby affording movement of that portion of its longitudinal axis adjacent its first end portion 15 in a total arc of over 60, 90 or 180 degrees respectively with respect to the portion of its longitudinal axis adjacent its second end portion 16.

The handle 2 has sufficient stiffness to afford positioning the bottom surface 12 of the step stool 1 by manual engagement of the handle 2 at its first end portion 15.

The step stool 1 can be a molding of polymeric material (e.g., like the lightweight plastic step stool manufactured by Rubbermaid Incorporated mentioned above) and can include a platform 18 having the top surface 14 and a plurality of (e.g., four) legs 20 projecting from the side of the platform 18 opposite the top surface 14, which legs 20 have distal ends defining the bottom surface 12. The second end portion 16 of the handle 2 can be attached to the step stool 1 along one of the legs 20, which attachment can be releasable (e.g., the second end portion 16 of the handle 2 can be in threaded engagement with the step stool 1).

As an example, the handle 2 can be a tube of polymeric (e.g., rubber) material having a length of about 25 inches and an outer diameter of about 2 inches.

The flexible high handle 2 allows the step stool assembly 10 to be made light in weight and makes it safe and easy to use.

What is claimed is:

1. A portable step stool assembly, said step stool assembly including a step stool defining a bottom surface adapted to be supported on a generally horizontal support surface and having a generally planar top surface generally parallel to and spaced a predetermined distance from said bottom surface, said top surface being adapted to be stepped on by a person, said step stool assembly further including an elongate resiliently flexible handle having a longitudinal axis and axially spaced first and second end portions, said handle having said second end portion attached to said step stool and being sufficiently stiff to normally remain generally straight with the axis of said handle projecting past said top surface at generally a right angle with respect to said top surface, and said handle being resiliently flexible in any direction normal to said axis to afford flexing of said handle without flexing of said step stool and without damage to said step stool assembly, and to restrict injury to a person falling against the first end portion of the handle, said resilient flexibility of said handle normal to said axis affording positioning of a portion of said longitudinal axis adjacent said first end portion at angles in either of two opposite directions of over 30 degrees with respect to a portion of said longitudinal axis adjacent said second end portion, thereby affording movement of said portion of said longitudinal axis adjacent said first end portion in a total arc of over 60 degrees with respect to said portion of said longitudinal axis adjacent said second end portion.

2. A portable step stool assembly according to claim 1 wherein said handle has sufficient stiffness to afford positioning said bottom surface of said step stool by manual engagement of said handle at said first end portion.

3. A portable step stool assembly according to claim 1 wherein said step stool is a molding of polymeric material and includes a platform having said top surface and a plurality of legs projecting from the side of said platform opposite said top surface, said legs having distal ends defining said bottom surface, and wherein said second end portion of said handle is attached to said step stool along one of said legs.

4. A portable step stool assembly according to claim 1 wherein said handle is a tube of polymeric material.

5. A portable step stool assembly according to claim 1 wherein said second end portion of said handle is releasably attached to said step stool.

6. A portable step stool assembly according to claim 1 wherein said flexibility of said handle normal to said axis affords positioning of a portion of said longitudinal axis adjacent said first end portion at angles in either of two opposite directions of over 45 degrees with respect to a portion of said longitudinal axis adjacent said second end portion. thereby affording movement of said portion of said longitudinal axis adjacent said first end portion in a total arc of over 90 degrees with respect to said portion of said longitudinal axis adjacent said second end portion.

7. A portable step stool assembly according to claim 1 wherein said flexibility of said handle normal to said axis affords positioning of a portion of said longitudinal axis adjacent said first end portion at angles in either of two opposite directions of over 90 degrees with respect to a portion of said longitudinal axis adjacent said second end portion, thereby affording movement of said portion of said longitudinal axis adjacent said first end portion in a total arc of over 180 degrees with respect to said portion of said longitudinal axis adjacent said second end portion.

8. A portable step stool assembly according to claim 1 wherein said handle has a length of about 25 inches and an outer diameter of about 2 inches.

9. A portable step stool assembly according to claim 1 wherein said step stool is of polymeric material and light in weight.

10. A portable step stool assembly, said step stool assembly including a step stool defining a bottom surface adapted to be supported on a generally horizontal support surface and having a generally planar top surface generally parallel to and spaced a predetermined distance from said bottom surface, said top surface being adapted to be stepped on by a person, said step stool assembly further including an elongate flexible handle having a longitudinal axis and axially spaced first and second end portions, said handle having said second end portion attached to said step stool and being sufficiently stiff to normally remain generally straight with the axis of said handle projecting past said top surface at generally a right angle with respect to said top surface, and said handle being flexible in any direction normal to said axis to afford flexing of said handle without flexing of said step stool and without damage to said step stool assembly, and to restrict injury to a person falling against the first end portion of the handle, said flexibility of said handle normal to said axis affording positioning of a portion of said longitudinal axis adjacent-said first end portion at angles in either of two opposite directions of over 30 degrees with respect to a portion of said longitudinal axis adjacent said second end portion, thereby affording movement of said portion of said longitudinal axis adjacent said first end portion in a total arc of over 60 degrees with respect to said portion of said longitudinal axis adjacent said second end portion.

11. A portable step stool assembly according to claim 10 wherein said handle has sufficient stiffness to afford positioning said bottom surface of said step stool by manual engagement of said handle at said first end portion.

12. A portable step stool assembly according to claim 10 wherein said step stool is a molding of polymeric material and includes a platform having said top surface and a plurality of legs projecting from the side of said platform opposite said top surface, said legs having distal ends defining said bottom surface, and wherein said second end portion of said handle is attached to said step stool along one of said legs.

13. A portable step stool assembly according to claim 10 wherein said handle is a tube of polymeric material.

14. A portable step stool assembly according to claim 10 wherein said second end portion of said handle is releasably attached to said step stool.

15. A portable step stool assembly according to claim 10 wherein said flexibility of said handle normal to said axis affords positioning of a portion of said longitudinal axis adjacent said first end portion at angles in either of two opposite directions of over 45 degrees with respect to a portion of said longitudinal axis adjacent said second end portion, thereby affording movement of said portion of said longitudinal axis adjacent said first end portion in a total arc of over 90 degrees with respect to said portion of said longitudinal axis adjacent said second end portion.

16. A portable step stool assembly according to claim 10 wherein said flexibility of said handle normal to said axis affords positioning of a portion of said longitudinal axis adjacent said first end portion at angles in either of two opposite directions of over 90 degrees with respect to a portion of said longitudinal axis adjacent said second end portion, thereby affording-movement of said portion of said longitudinal axis adjacent said first end portion in a total arc of over 180 degrees with respect to said portion of said longitudinal axis adjacent said second end portion.

17. A portable step stool assembly according to claim 10 wherein said handle has a length of about 25 inches and an outer diameter of about 2 inches.

18. A portable step stool assembly, said step stool assembly including a step stool molded of polymeric material, said step stool including a platform having a generally planar top surface adapted to be stepped on by a person and including a plurality of legs projecting from the side of said platform opposite said top surface, said legs having distal ends defining a bottom surface generally parallel to and spaced a predetermined distance from said top surface and adapted to be supported on a generally horizontal support surface, said step stool assembly further including an elongate resiliently flexible polymeric handle having a longitudinal axis and axially spaced first and second end portions with said second end portion being attached to said step stool along one of said legs, said handle being sufficiently stiff to normally remain generally straight with the axis of said handle projecting past said top surface at generally a right angle with respect to said top surface and to afford positioning said bottom surface of said step stool by manual engagement of said handle at said first end portion, said handle being resiliently flexible in any direction normal to said axis to afford flexing of said handle without flexing of said step stool and to restrict injury to a person falling against the first end portion of the handle, said resilient flexibility of said handle normal to said axis affording positioning of a portion of said longitudinal axis adjacent said first end portion at angles in either of two opposite directions of over 30 degrees with respect to a portion of said longitudinal axis adjacent said second end portion, thereby affording movement of said portion of said longitudinal axis adjacent said first end portion in a total arc of over 60 degrees with respect to said portion of said longitudinal axis adjacent said second end portion.

* * * * *